US005603274A

United States Patent [19]

Conley, Jr. et al.

[11] Patent Number: 5,603,274

[45] Date of Patent: Feb. 18, 1997

[54] CLAMPING DEVICE FOR A SEWING MACHINE

[75] Inventors: Ralph F. Conley, Jr.; Ricky J. Frye, both of Miamisburg, Ohio

[73] Assignee: MIM Industries, Inc., Miamisburg, Ohio

[21] Appl. No.: 196,585

[22] Filed: Feb. 15, 1994

[51] Int. Cl.[6] ..... D05B 21/00; D05B 3/22

[52] U.S. Cl. ..... 112/470.14; 112/470.06; 112/475.07; 112/475.09; 112/113; 112/114; 112/DIG. 2

[58] Field of Search ..... 112/303, 121.12, 112/121.15, DIG. 2, 104, 113, 114, 475.07, 475.08, 475.09, 470.06, 470.14, 311

[56] References Cited

U.S. PATENT DOCUMENTS

| | | | |
|---|---|---|---|
| 1,408,474 | 3/1922 | Russell . | |
| 4,411,721 | 10/1983 | Wishart | 156/73.1 |
| 4,485,754 | 12/1984 | MacDonald . | |
| 4,498,404 | 2/1985 | Sadeh | 112/DIG. 2 X |
| 4,590,872 | 5/1986 | Bray | 112/113 X |
| 4,714,034 | 12/1987 | Riss et al. | 112/113 |
| 4,756,261 | 7/1988 | Gershoni | 112/DIG. 2 X |
| 4,790,523 | 12/1988 | Tomer | 112/121.29 X |
| 5,052,316 | 10/1991 | Sakakibara . | |

OTHER PUBLICATIONS

MIM Industries, Inc., "the technologies of MIM industries, inc.", published approximately Jan. 1, 1990, p. 56.

*Primary Examiner*—Paul C. Lewis

*Attorney, Agent, or Firm*—Jacox, Meckstroth & Jenkins

[57] ABSTRACT

A clamping device for use in a sewing machine. The clamping device includes a clamping plate having a downwardly facing clamping surface for clamping a first workpiece to a sewing surface of a sewing machine wherein the clamping plate is supported for vertical movement beneath a sewing head for the sewing machine. The clamping plate is provided with a vacuum aperture which is in fluid connection with a vacuum source wherein the vacuum source draws a second workpiece into engagement with the clamping plate. A support plate is provided for supporting the second workpiece beneath the clamping plate and a feed mechanism is provided for feeding the second workpiece onto the support plate. In operation of the present invention, the feed mechanism feeds one of the second workpieces onto the support plate and the vacuum source is actuated to create a vacuum at the downwardly facing clamping surface of the clamping plate to thereby move the second workpiece from the support plate into engagement with the clamping plate. Thereafter, the clamping plate is moved downwardly into engagement with the first workpiece to thereby clamp the first and second workpieces together for a sewing operation.

21 Claims, 5 Drawing Sheets

CLAMPING DEVICE FOR A SEWING MACHINE

BACKGROUND OF THE INVENTION

1. Field of the Invention

This invention relates to a clamp, and more particularly, it relates to a clamp for use in a sewing machine wherein the clamp is provided with a source for holding a workpiece in association with a surface of the clamp.

2. Description of Related Art

In the sewing industry, a common repetitive function is to sew collar stays, comprised of elongated planar members formed of a stiff material such as plastic, onto a sewable article, such as a shirt collar. A clamp was typically used to hold a collar stay in association with a shirt collar during a sewing operation in a sewing machine and the clamp included an opening corresponding to the shape of the collar stay. The collar stay would be fed by a feed mechanism from a stack of collar stays, and an operator would take each stay from the feed mechanism and place it within the opening in the clamp whereby the opening defined a template for holding the collar stay in place. Subsequently a collar was placed in association with the collar stay and the sewing machine then moved the collar and stay under an oscillating needle in order to sew the stay onto the collar.

Accordingly, it is apparent that the prior method of aligning collar stays within a sewing machine was relatively labor intensive in that an operator was required to transfer the collar stays from the feed mechanism to the opening in the clamp. Further, the speed at which the overall operation of attaching collar stays could be performed has been partly dependent on the dexterity of the operator in transferring the stays to the clamp.

SUMMARY OF THE INVENTION

There is, therefore, a present need to provide a clamp for receiving workpieces wherein the clamp accurately aligns the workpieces underneath a sewing head and clamps the workpieces to a sewable article in preparation for a sewing operation.

In one aspect, this invention includes a clamping device for use in a sewing machine wherein the clamping device comprises a clamping member having a clamping area for clamping a first workpiece under a sewing head of the sewing machine; and holding means associated with the clamping member for creating a pressure at the clamping area.

In a further aspect of the invention, the holding means comprises a vacuum source connected to an aperture defined at the clamping area whereby a second workpiece is held in engagement with the clamping member.

In another aspect of the invention, a support member is provided for supporting the second workpiece underneath the clamping member and a feed mechanism is provided for feeding the second workpiece onto the support member. The holding means is adapted to draw the second workpiece up into engagement with a lower surface of the clamping member and the clamping member is provided with an indented area whereby the second workpiece is properly aligned relative to the clamping member. The clamping member is movable in a vertical direction toward a sewing surface of the sewing machine whereby the second workpiece is held in clamped relation against the first workpiece on the sewing surface during a sewing operation.

It is yet another object of the invention to provide a method of clamping a workpiece in a sewing machine comprising the steps of aligning a workpiece and a clamp surface adjacent to each other; and producing an air pressure at the clamp surface causing the workpiece to engage the clamp surface at a predetermined location.

It is therefore an object of the present invention to provide a clamping device for receiving a workpiece and for holding the workpiece as it is moved into clamping association with an article to be sewn, It is a further object of the invention to provide such a clamping device wherein a vacuum source is provided to hold the workpiece in association with the clamping device, It is another object of the invention to provide a method of clamping a workpiece in a sewing machine wherein an air pressure is used to cause a workpiece to engage a clamp surface at a predetermined location, It is yet a further object of the invention to provide a method of clamping a workpiece wherein the workpiece is held in association with the clamp by means of a vacuum and the clamp is movable with the workpiece into engagement with a sewable article, Other objects and advantages of the invention will be apparent from the following description, the accompanying drawings, and the appended claims,

DETAILED DESCRIPTION OF THE PREFERRED EMBODIMENT

Figure 1:
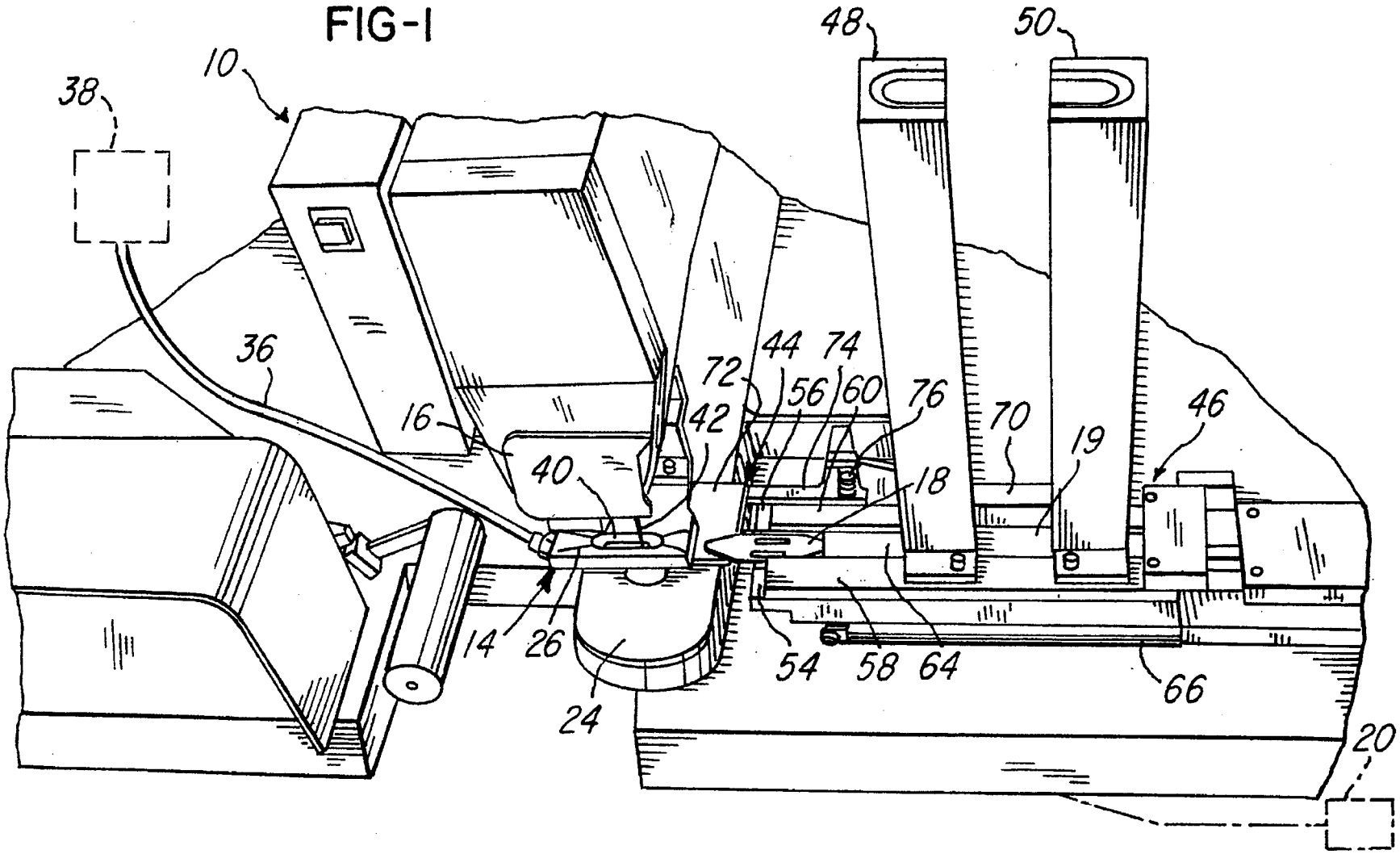
FIG. 1 is a front perspective view showing the clamping device of the present invention in association with a sewing machine with the support member positioned under the clamping member to receive a workpiece.
Figure 5:
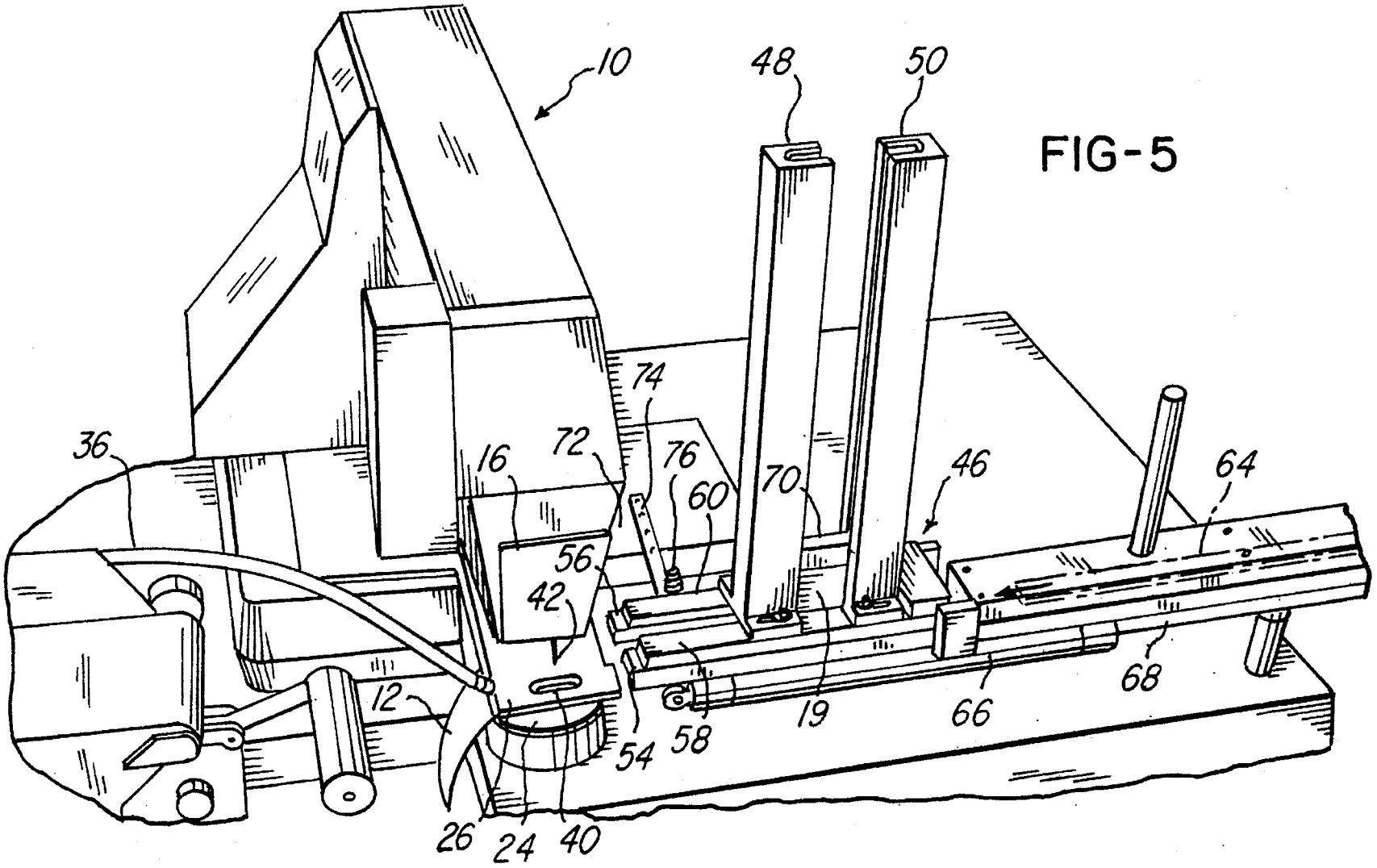
FIG. 5 is a front perspective view illustrating the clamping member in a lowered position to clamp workpieces to a sewing surface for a sewing operation.

FIG. 1 shows a perspective view of a portion of a programmable sewing machine, hereinafter designated as sewing machine 10, in which a preferred embodiment of this invention may be used. The sewing machine 10 may be any programmable sewing machine, including any of the Brother BAS Series 300 programmable sewing machines, which are manufactured by Brother Industries of Japan. The sewing machine 10 includes a sewing head 16 located over a sewing surface 24 for supporting a first workpiece 12, such as a shirt collar (see FIG. 5). A clamping member 14 is provided supported between the sewing head 16 and the sewing surface 24 for supporting a second workpiece 18, such as a collar stay, and for clamping the first and second workpieces 12 and 18 on the sewing surface 24. In a preferred embodiment, the second workpiece 18 is sewn onto the first workpiece 12 in an operation wherein the clamping member 14 moves the first and second workpieces beneath the sewing head 16 in accordance with a computer program controlled by a master controller, depicted diagrammatically as 20, which is associated with the sewing machine 10.

The clamping member 14 is supported within the sewing machine 10 by an arm 22 (see FIG. 4) wherein the arm 22 supports the clamping member 14 for vertical movement beneath the sewing head 16 toward and away from the sewing surface 24 of the sewing machine 10. The arm 22 is of a known type and may be similar to the clamp supporting arm disclosed in connection with U.S. Pat. No. 4,870,917 to Frye, assigned to the assignee of the present invention, and incorporated herein by reference.

Figure 2:
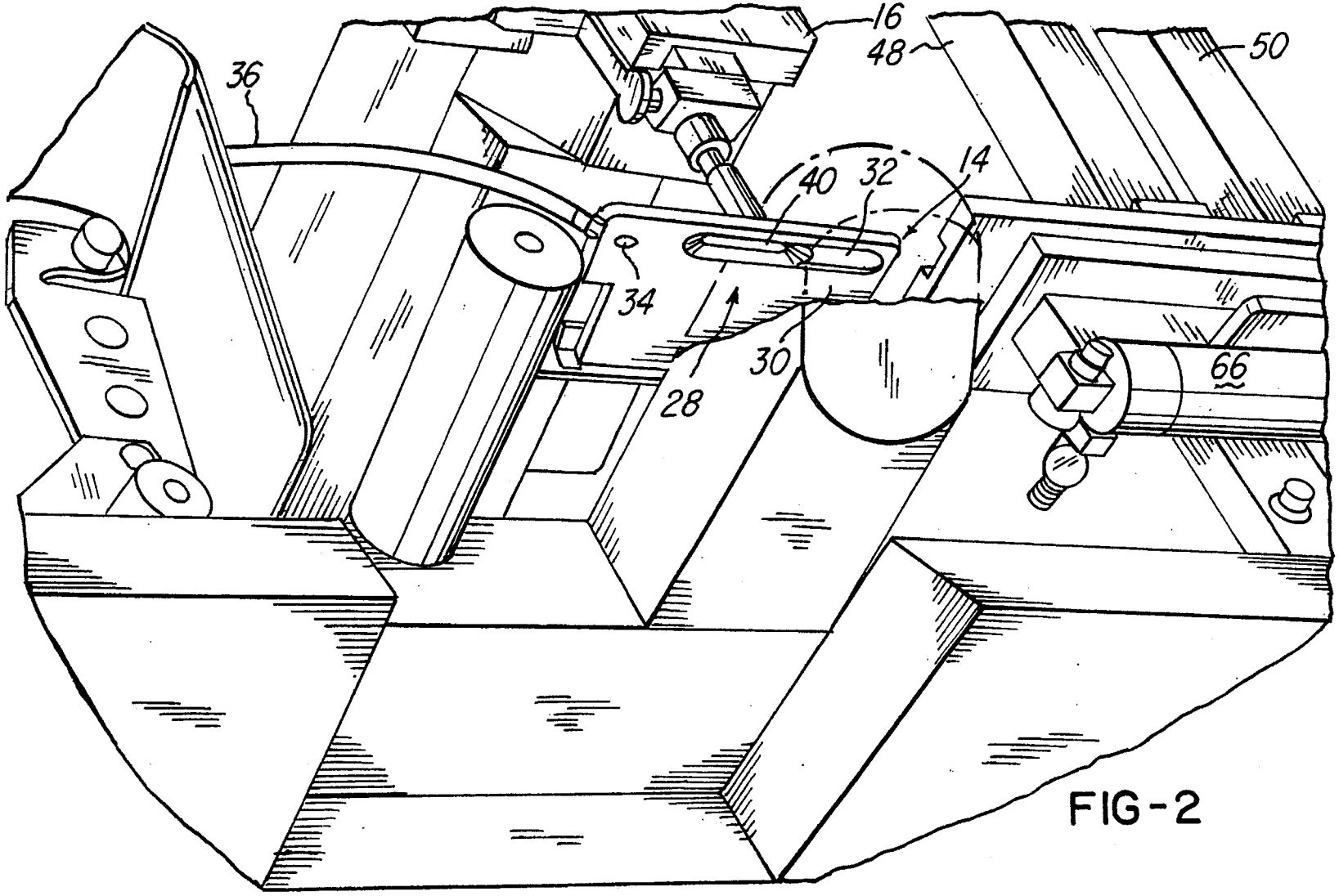
FIG. 2 is a bottom perspective view illustrating the bottom of the clamping plate.

Referring to FIGS. 1 and 2, the clamping member 14 is formed as a substantially planar plate-like member having an upper portion 26 and a lower clamping area 28 wherein the clamping area 28 includes a clamping surface 30 for clamping the first workpiece 12, for example a sewable article such as a shirt collar, to the sewing surface 24. In addition, a recessed or indented area 32 is defined in the clamping area 28 for receiving a second workpiece 18, such as a collar stay, and the indented area 32 is configured to closely correspond to the shape of the second workpiece 18 whereby the indentation 32 forms a template for aligning the second workpiece 18 relative to the clamping member 14, as well as relative to the sewing head 16.

The clamping member 14 further includes means defining a vacuum aperture 34 opening into the indented area 32 and which includes a passage extending through a side of the clamping member 14 to a tube or hose 36 extending to a vacuum source, depicted diagrammatically as 38. The vacuum source 38, hose 36 and aperture 34 define holding means associated with the clamping member 14 for creating a negative pressure or vacuum at the clamping area 28. This negative pressure or vacuum is adapted to draw the second workpiece 18 into engagement with the indented area 32 whereby the second workpiece 18 will be held on the clamping member 14 until the vacuum provided by the vacuum source 38 is discontinued. The clamping member 14 further includes means defining an aperture 40 extending through the member 14 from the upper portion 26 to the indented area 32. The aperture 40 is adapted to receive a sewing needle 42 therethrough wherein the needle 42 is reciprocated through the aperture 40 to sew the second workpiece 18 to the first workpiece 12 during a sewing operation.

Figure 3:
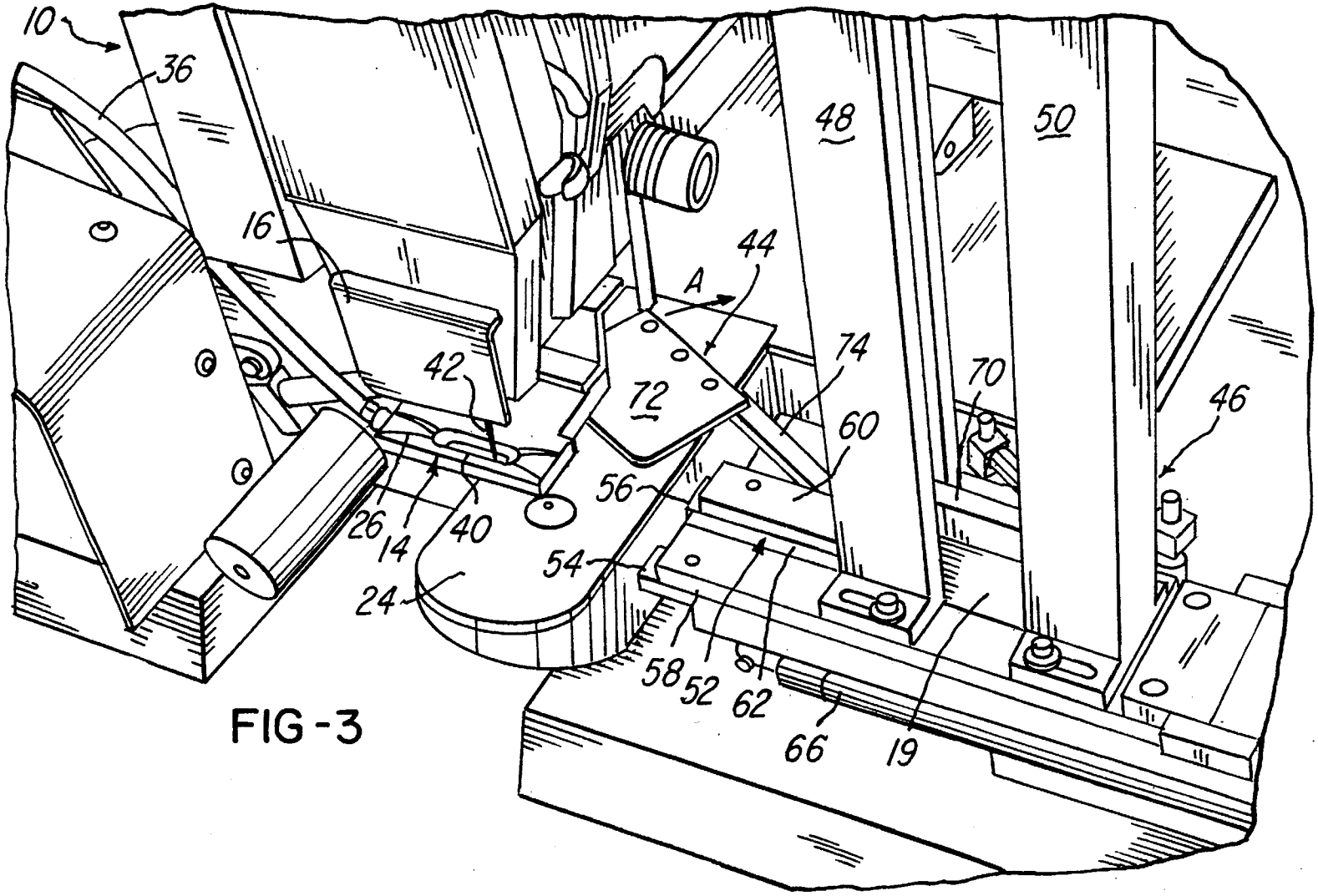
FIG. 3 is a frame perspective view illustrating the pivoting movement of the support member.

Referring to FIGS. 1 and 3, the clamping device of the present invention further includes a support member 44 for supporting the second workpiece 18 and a feed mechanism 46 which is adapted to automatically feed second workpieces 18 in succession from a stack 19 of second workpieces 18 onto the support member 44. The feed mechanism 46 includes a storage area defined by vertically extending C-channels 48 and 50 which are located facing! each other to define a guide path for the stack 19 of second workpieces 18, which in the preferred embodiment are thin elongated plastic collar stays, wherein the second workpieces 18 are arranged in vertically stacked relation. The feed mechanism 46 further includes a feed chute 52 defined by elongated plates 54 and 56 forming side walls for the chute 52 and plates 58 and 60 forming upper edges for retaining the second workpieces 18 within the chute 52. In addition, a lower or base plate 62 forms a lower surface for supporting the workpieces 18 as they pass through the chute 52. The second workpieces 18 drop by gravity downwardly through the guide path formed by the channels 48 and 50 onto the lower plate 62, and the lowermost of the second workpieces 18 in the stack is pushed forwardly toward the clamping member 14 by a pusher plate 64 slidably positioned within the channel 52 (see FIGS. 1 and 5). The pusher plate 64 is preferably actuated by a pneumatic cylinder 66 wherein a reciprocating rod 68 of the cylinder 66 is connected to the pusher plate 64. In addition, the cylinder 66 is preferably actuated by the controller 20 in accordance with the computer program for controlling the sewing operation. Further, the downward movement of the stack 19 of second workpieces 18 through the passage defined by the channels 48 and 50 may be facilitated by providing an additional weight 70, such as a metal bar resting on top of the uppermost one of the workpieces 18 in the stack 19.

Figure 4:
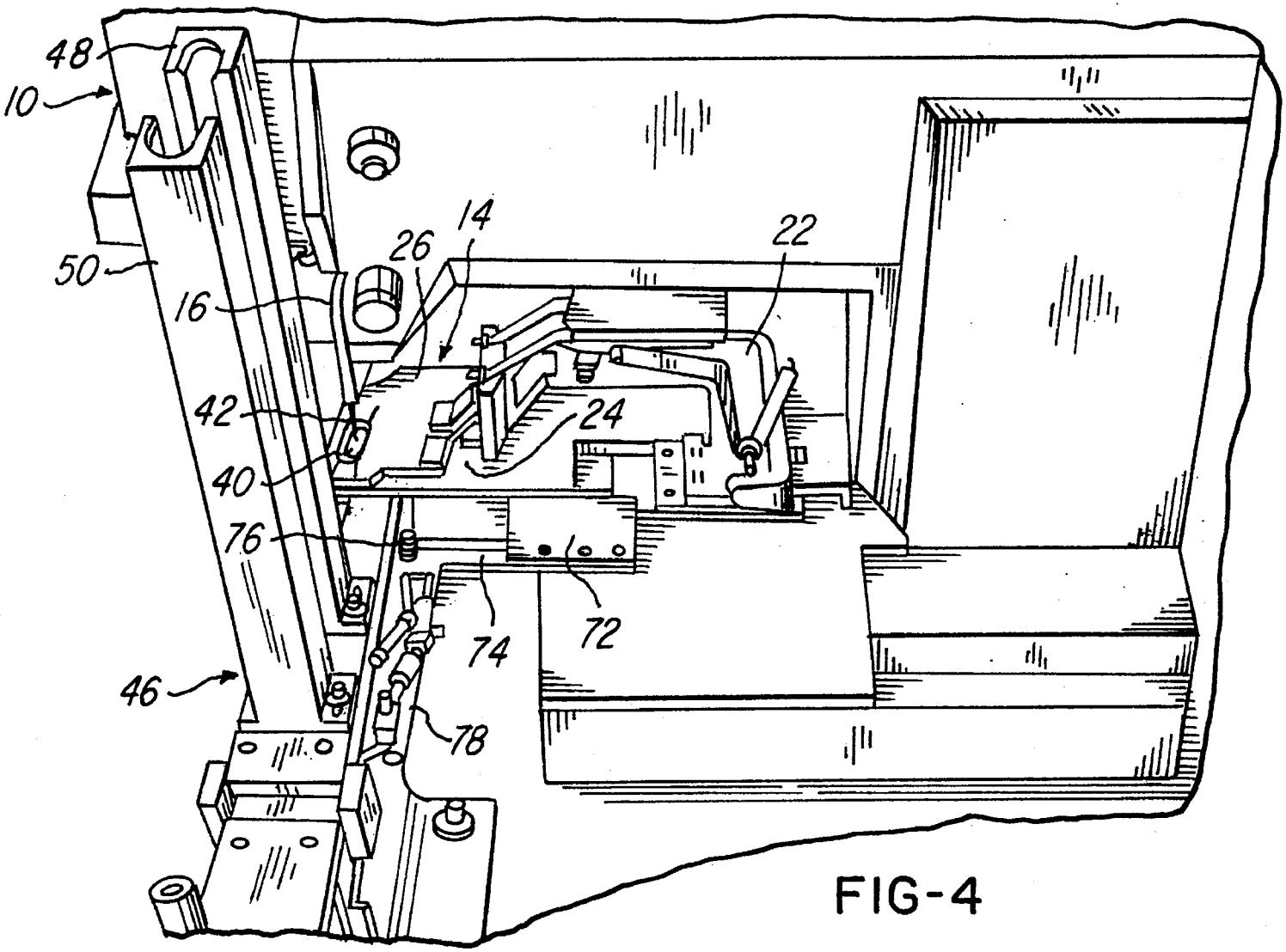
FIG. 4 is a side perspective view illustrating the support member pivoted away from the clamping member.

Referring to FIG. 4, the support member 44 includes a support plate 72 attached to a pivot arm 74, and the pivot arm 74 is supported for movement relative to the sewing machine 10 at a pivot point 76. The pivot arm 74 is preferably actuated for movement by a pneumatic cylinder 78 having a reciprocating actuator rod 80 operably connected to the arm 74 wherein operation of the cylinder 78 is controlled by controller 20. The upper surface of the plate 72 is located at substantially the same level as the surface defined by the lower plate 62 of the chute 52 such that the pusher plate 64 will push a second workpiece 18 from the chute 52 onto the plate 72 directly beneath the clamp member 14. It should be noted that during the operation of feeding a second workpiece 18 onto the plate 72, the clamping member 14 is located in an uppermost position such that the plate 72 may be pivoted to a first location between the clamping member 14 and the sewing surface 24.

Once a second workpiece 18 has been fed onto the support plate 72 and adjacent to the clamping area 28 of the clamping member 14, as is best illustrated in FIG. 1, a negative pressure or vacuum is applied through the hose 36 from the vacuum source 38 to the indented area 32 to draw the second workpiece 18 from the support plate 72 up into contact with the clamping member 14 at the indented area 32. As the workpiece 18 is drawn into engagement with the clamping member 14, the walls defining the indented area 32 align the workpiece 18 relative to the clamping member 14, as well as relative to the sewing head 16 of the sewing machine 10. With the second workpiece 18 thus engaged with the clamping member 14, the support member 44 is pivoted to a second position away from the clamping member 14 and the sewing surface 24, as is illustrated by arrow A in FIG. 3, and a first workpiece 12 may be supplied to the sewing surface 24. Subsequently, the clamping member 14 is actuated for movement down onto the first workpiece 12 to thereby clamp it to the sewing surface 24. With the first workpiece 12 thus clamped, the second workpiece 18 is also clamped or located in position adjacent to the first workpiece 12 and the vacuum to the clamping member 14 is discontinued. Finally, the sewing needle 42 is actuated to sew the second workpiece 18 onto the first workpiece 12 under operation of the controller 20. When the sewing operation is completed, the clamping member 14 will be actuated to move to its uppermost position such that the completed sewn article may be removed, and the cylinder 78 will be actuated to again move the support plate 72 into position between the clamping member 14 and the sewing surface 24 in preparation for receiving another one of the second workpieces 18.

It should be noted that the present invention is not intended to be limited to the above-described method of feeding and supporting workpieces for engagement with the clamping member 14 and that other configurations for feeding the workpieces to the clamping member 14 may be provided. For example, the clamping member 14 may be adapted for movement to a position where it picks up the second workpieces 18, and is subsequently moved to its operating position beneath the sewing head 16 while carrying the workpiece 18, such that the need for the support member 44 may be eliminated.

It should be apparent from the above description of the invention that the present invention provides an efficient manner for aligning a workpiece such as a collar stay to a location within a sewing machine and for transferring the workpiece into clamping engagement with an article that the workpiece is intended to be sewn onto. Further, it should be apparent that the clamping device of the present invention facilitates automation of the handling and sewing of workpieces onto sewable articles by utilizing a vacuum holding means to draw the workpieces into engagement with the clamp.

While the form of apparatus herein described constitutes a preferred embodiment of the invention, it should be understood that the invention is not limited to this precise form of apparatus, and that changes may be made therein without departing from the scope of the invention, which is defined in the appended claims.

What is claimed is:

1. A clamping device for use in a sewing machine, said clamping device comprising:

a clamping member having a clamping area for clamping a first workpiece under a sewing head of said sewing machine; and holding means associated with said clamping member for creating a negative pressure at said clamping area, wherein said clamping area faces downwardly from said clamping member and said holding means is operable to retain a second workpiece on said clamping area, wherein said clamping area is defined by a clamping surface for engaging said first workpiece and an indented portion recessed from said clamping surface for engaging said second, workpiece.

2. The clamping device as recited in claim 1 including means defining an aperture through said clamping member at said indented portion for receiving a needle of said sewing machine therethrough.

3. A clamping device in combination with a programmable sewing machine having a sewing head, said clamping device comprising:

a clamping plate having a downwardly facing clamping surface for forcing a first workpiece into contact with a sewing surface of said sewing machine, said clamping plate being supported for vertical movement beneath said sewing head;

a vacuum source;

means defining a vacuum aperture adjacent to said clamping surface;

means connecting said vacuum source in fluid communication with said vacuum aperture;

a support plate for supporting a second workpiece beneath said clamping plate;

a controller for controlling a sewing operation and for actuating said vacuum source; and wherein actuation of said vacuum source causes said second workpiece to move from said support plate into engagement with said clamping plate.

4. The apparatus as recited in claim 3 wherein said clamping plate is located to hold said second workpiece in association with said first workpiece for said sewing head to sew said first and second workpieces together.

5. The apparatus as recited in claim 3 wherein said controller positions said support plate at a first location which is between said clamping plate and said sewing surface, and at a second location which is spaced apart in a horizontal direction from said clamping plate.

6. The apparatus as recited in claim 3 including a storage area for storing a plurality of second workpieces and a feed chute associated with said storage area for feeding said second workpieces to said support plate.

7. The apparatus as recited in claim 3 including means defining a sewing aperture in said clamping plate for receiving a sewing needle therethrough during a sewing operation.

8. A method of clamping a first workpiece in a sewing machine having a sewing surface comprising the steps of:

(a) aligning a first workpiece and a clamp surface adjacent to each other;

(b) producing an air pressure at said clamp surface causing said first workpiece to engage said clamp surface at a predetermined location; and (c) forcing a second workpiece with said clamp surface into contact with said sewing surface so as to clamp said first workpiece and said second workpiece in said sewing machine.

9. The method as recited in claim 8 wherein said air pressure in said step (b) comprises a vacuum drawing said first workpiece into engagement with said clamp surface.

10. The method as recited in claim 8 wherein said step (a) comprises feeding said first workpiece onto a support member for supporting said first workpiece prior to said step (b).

11. The method as recited in claim 8 wherein said step (a) further comprises locating said first workpiece under a sewing head for said sewing machine.

12. The method as recited in claim 8 wherein said first workpiece comprises a collar stay for a shirt.

13. A method of clamping a workpiece in a sewing machine comprising the steps of:

(a) aligning workpiece and a clamp surface adjacent to each other;

(b) producing an air pressure at said clamp surface causing said workpiece to engage said clamp surface at a predetermined location, wherein said step (a) comprises feeding said workpiece onto a support member for supporting said workpiece prior to said step (b); and (c) moving said support member in a direction away from said clamp surface subsequent to said step (b).

14. A method of clamping two workpieces in a sewing machine having a sewing surface comprising the steps of:

(a) feeding a workpiece to a location adjacent to a clamp;

(b) producing a vacuum at said clamp causing said workpiece to engage said clamp;

(c) moving said clamp and said workpiece into engagement with a sewable article; and (d) causing said clamp to force said sewable article into contact with said sewing surface so as to clamp said workpiece and said sewable article in said sewing machine.

15. The method as recited in claim 14 wherein said step (a) comprises feeding said workpiece onto a support plate located beneath said clamp.

16. The method as recited in claim 14 further comprising the step of:

(e) feeding a plurality of said workpieces in succession to said clamp.

17. The method as recited in claim 14 wherein said step (d) comprises clamping said workpiece and said sewable article onto said sewing surface in said sewing machine.

18. The method as recited in claim 14 further comprising the steps of:

(e) terminating said vacuum; and (f) sewing said workpiece to said sewable article.

19. A method of clamping a workpiece in a sewing machine having a sewing surface comprising the steps of:

(a) positioning a clamp having a retaining area at a predetermined position at a sewing station;

(b) causing a workpiece to be retained in said retaining area and (c) forcing a sewable article with said clamp into contact with said sewing surface so as to clamp said workpiece and said sewable article at said sewing station;

wherein said step (b) further comprises:

applying an air pressure to retain said workpiece on said retaining area.

20. The method as recited in claim 19 wherein said air pressure is a vacuum.

21. The method as recited in claim 19 wherein step (c) includes the step of:

simultaneously clamping the workpiece against the sewable article while clamping the sewable article against the sewing surface of the sewing machine.

* * * * *